United States Patent [19]

Bierling

[11] 4,319,547

[45] Mar. 16, 1982

[54] LIQUID-COOLED INTERNAL COMBUSTION ENGINE

[75] Inventor: Rudolf Bierling, Eselsberg, Fed. Rep. of Germany

[73] Assignee: Audi NSU Auto Union Aktiengesellschaft, Fed. Rep. of Germany

[21] Appl. No.: 68,214

[22] Filed: Aug. 20, 1979

[30] Foreign Application Priority Data

Sep. 23, 1978 [DE] Fed. Rep. of Germany ..... 2841555

[51] Int. Cl.[3] ..... F01P 7/16

[52] U.S. Cl. ..... 123/41.29; 123/41.08; 123/41.74

[58] Field of Search ..... 123/41.02, 41.08, 41.09, 123/41.29, 41.28, 41.74; 236/34.5; 137/625.5

[56] References Cited

U.S. PATENT DOCUMENTS 2,277,113 3/1942 Kimmel ..... 123/41.08
2,695,012 11/1954 Brubaker ..... 123/41.29
3,358,654 12/1967 Shanahan et al. ..... 123/41.08
3,521,610 7/1970 Coudriet ..... 123/41.08
3,921,600 11/1975 Henning et al. ..... 123/41.02

FOREIGN PATENT DOCUMENTS 826395 1/1952 Netherlands ..... 137/625.5

*Primary Examiner*—Charles J. Myhre
*Assistant Examiner*—W. R. Wolfe
*Attorney, Agent, or Firm*—Kane, Dalsimer, Kane, Sullivan and Kurucz

[57] ABSTRACT

A liquid cooled internal combustion engine having coolant cavities in the cylinder block and cylinder head, connected to a coolant circulating pump through a temperature controlled regulating device. The arrangement is such that below a selected temperature coolant circulates through the cylinder head only while above this temperature the coolant circulates through both the cylinder head and the cylinder block.

10 Claims, 5 Drawing Figures

LIQUID-COOLED INTERNAL COMBUSTION ENGINE

BACKGROUND OF THE INVENTION

This invention relates to a liquid-cooled internal combustion engine having a cylinder block and a cylinder head, formed with coolant cavities which have inlet and/or return ports which can be connected to the input or output side of a recirculating pump, and a temperature-controlled regulating device for controlling the flow of coolant through the said cavities.

In one such internal combustion engine, for example, the flow of the coolant through the cylinder head is released by a thermostat only when the engine has reached its operating temperature. Because the coolant is not circulated through the cylinder head cavity surrounding the combustion chamber during the warming up phase, rapid heating of this part of the engine occurs, designed to produce optimal operating conditions of the internal combustion engine a short time after starting. On the other hand, with this design since the comparatively cold coolant constantly flows through the cylinder block, particularly after cold starting, only delayed heating of this part of the engine can take place so that considerable friction losses and cold wear in the cylinders occur in these operating conditions.

SUMMARY OF THE INVENTION

The problem underlying the invention is to avoid the disadvantages described, and produce a liquid-cooled internal combustion engine of the type referred to in which rapid heating up is possible, but friction losses and cold wear are minimized.

The invention consists in a liquid-cooled internal combustion engine having a cylinder block and a cylinder head, formed with coolant cavities which have inlet and/or return ports which can be connected to the input or output side of a recirculating pump, and a temperature-controlled regulating device for controlling the flow of coolant through the said cavities the said regulating device having an inlet which is connected to the output of the recirculating pump, a first outlet which communicates with the inlet port of the cavity in the cylinder head and a second outlet port which communicates with the inlet port of the cavity in the cylinder block and also a valve body which, depending upon the temperature of the cylinder block adopts either a first position and closes the second outlet when the temperature lies below a selected value, and adopts a second position and opens the second outlet when the temperature is above this value.

As a result of this arrangement, in which, in contrast to the known prior construction, the coolant flows constantly through the cylinder head and only flows through the cylinder block after reaching the running temperature, the coolant which is retained in the cylinder block and does not circulate before the running temperature is reached, can be heated very rapidly. The cylinder walls in the cylinder block can also be heated very rapidly, whereby the friction losses which tend to occur after a cold start can very quickly be reduced and cold wear is minimized. The quantity of coolant which circulates through the cylinder head is less than the quantity in the cylinder block, and, moreover, after cold starting and in the warming up phase this coolant is diverted via the normal coolant bypass circuit, which contains only a small quantity of coolant, so that this coolant can be heated far more rapidly by the sequence of combustion taking place in the cylinder head, and the engine as a result, reaches its designed running temperature after a relatively short time. On the other hand, if the running temperature falls, for example, during coasting of the vehicle, whereby coolant continues to flow through the cylinder head, the quantity of coolant which is in the cylinder block and is controlled by the valve can maintain its temperature, so that unbalanced cooling of one section of the engine is avoided in these operating conditions.

In one embodiment of the invention the cavities of the cylinder head and cylinder block are connected in series and the aforementioned circulation of the coolant is produced by the first outlet of the regulating device being shut off in the second position.

In another embodiment the cavity in the cylinder head and the cavity in the cylinder block are connected in parallel, and the inlet and the first outlet of the regulating device communicates with each other in each position of the valve body.

The valve body of the regulating device can be under the action of a spring, which urges the valve body of the regulating device towards its second position. Thus no overheating of the cylinder walls is likely to occur if the valve body fails to operate, as the coolant constantly flows through the cylinder block in this position.

To shift the valve body into its first position, in which the coolant flows only through the cylinder head the valve body can be operable by an electro-magnet actuated by a temperature-controlled relay. It is also possible for the valve body to be operable by a pressure capsule, which can be connected either to a suction source or to atmosphere via a temperature-controlled valve.

A throttle maybe located in a ventilation line of the pressure capsule, to produce a gradual movement of the valve body from the first to the second position, and therefore a correspondingly delayed opening of the second outlet of the regulating device, to admit the coolant to the cylinder block.

The temperature-controlled valve which connects the pressure capsule to a low-pressure source or to atmosphere can be an electromagnetic valve actuated by a temperature-controlled relay.

The temperature-controlled relay may be a threshold switch which has a hysteresis of up to 20°. This property makes it possible for a correspondingly delayed opening or closing of the valve body to occur when the temperature of the cylinder block varies, whereby the cylinder walls have an advantageous temperature range with low friction losses even outside the actual warming-up phase.

For direct sensing of the temperature of the cylinder block, it is of advantage to locate a temperature sensor for measuring the cylinder wall temperature in the cylinder block close to the point at which the upper piston ring of a piston within the cylinder comes to rest in its top dead-centre position.

BRIEF DESCRIPTION OF THE DRAWINGS

The invention maybe performed in various ways and one specific embodiment with a number of possible modifications will now be described by way of example with reference to the accompanying drawings, in which.

DETAILED DESCRIPTION OF THE INVENTION

Figure 1:
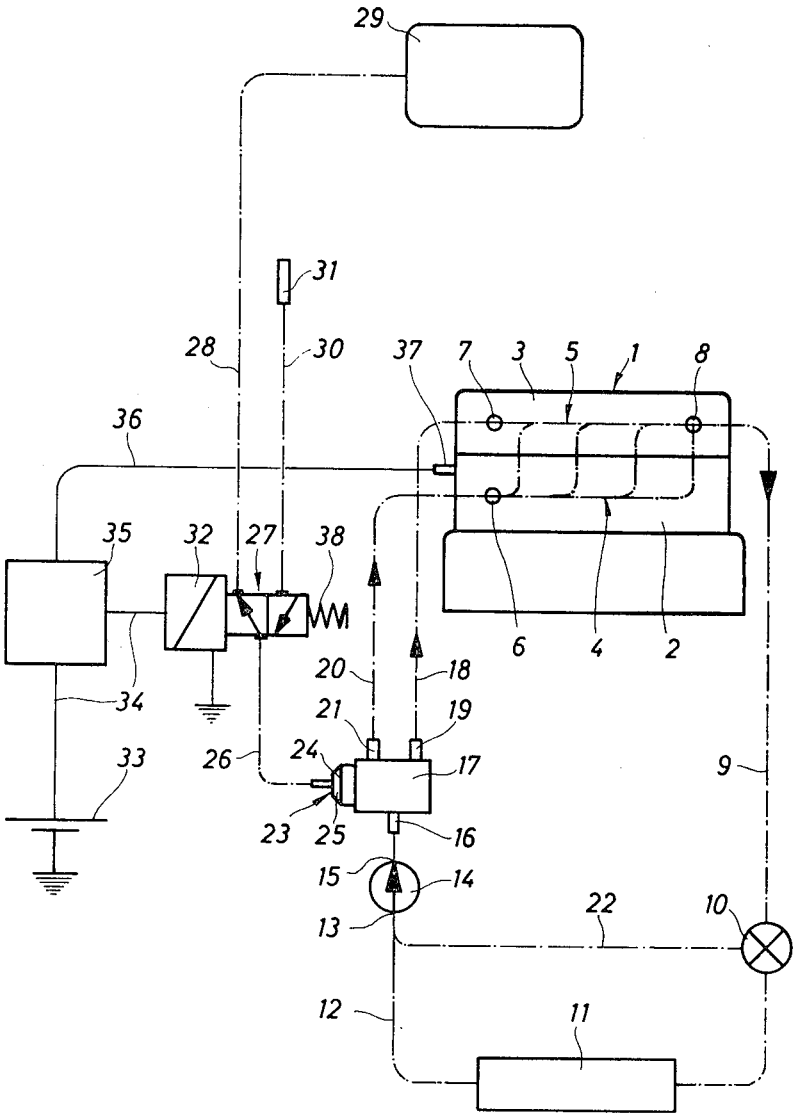
FIG. 1 is a diagrammatic illustration of an internal combustion engine with a coolant circuit arranged in accordance with the invention.

In the diagrammatic general view of a coolant circuit shown in FIG. 1, a liquid-cooled internal combustion engine is illustrated at 1, and consists essentially of a cylinder block 2 and a cylinder head 3. The cylinder block 2 encloses and surrounds the cylinders with the pistons located therein, and has an internal cavity or jacket 4 shaped in the usual way for the coolant to flow through. The cylinder head 3 defines the combustion chambers and also the intake and exhaust ducts and is formed with a cavity 5 for the coolants. The cylinder block 2 has an inlet 6 for circulating the coolant through the cavity 4 and an inlet 7 and an outlet or return port 8 are provided for this purpose in the cylinder head 3. The cavities 4 and 5 are connected together at the junction between the cylinder block 2 and the cylinder head 3 by orifices which are not shown in greater detail, so that the inlet 6 is connected to the return port 8 via the series circuit formed thereby.

From the return port 8, a coolant pipe 9 leads via a thermostatic controller 10 to a cooler 11, from which another coolant pipe 12 leads to the suction side 13 of a circulating pump 14. The pressure side 15 of the circulating pump 14 is connected to the inlet 16 of a temperature-controlled regulating device 17, which has a first outlet 19 communicating via a pipe 18 with the inlet 7 of the cylinder head 3, and a second outlet 21 which communicates via a pipe 20 with the inlet connection 6 of the cylinder block 2. From the thermostatic controller 10 a bypass pipe 22 branches off and avoids the cooler 11 and is likewise connected to the suction side 13 of the circulating pump 14.

The regulating device 17, which is described more precisely in the following description of FIGS. 2 and 3, contains a valve body which is not shown in this illustration and is actuated by a pressure capsule 23. The pressure capsule 23 has, for this purpose, a diaphragm 24, which defines a low-pressure chamber 25 and is connected to the valve body. To the low-pressure chamber 25 is connected a pipe 26, which is connected via a temperature-controlled valve 27 either through a pipe 28 to a low-pressure source 29 (e.g. vacuum pump or inlet manifold of the internal combustion engine) or through a pipe 30 and a throttle 31 to the atmosphere. The valve 27 is governed by a solenoid 32, having a circuit 34, which includes a battery 33, and a temperature-controlled relay 35. A temperature sensor 37 is connected via a pipe 36 to the relay 35, which is a threshold switch with a hysteresis of up to approximately 20°, the sensor being arranged in the cylinder block 2 close to the point at which the upper piston ring of the piston in the cylinder comes to rest in its top dead-centre position.

In order to produce rapid heating of the internal combustion engine 1, the cooling fluid circuit functions in the following manner. When the ignition circuit of the engine is switched on, the solenoid 32 is simultaneously activated and hence the valve 27 is moved against the force of a spring 38 into the position shown in which the low-pressure chamber 25 is connected via the pipes 26 and 28 to the low-pressure source 29. As a result of the low-pressure which consequently occurs in the low-pressure chamber 25, the valve body within the control device 17, which is connected to the diaphragm 24, is drawn into a first position, in which the second outlet 21 is shut off and the first outlet 19 is opened, so that the coolant which is circulated by the pump 14 is passed via the pipe 18 through the cavity 5 of the cylinder head 3, and via the pipe 9 and the thermostat 10, (which adopts a position corresponding to the temperature of the coolant after cold starting) passes through the pipe 22 back to the pump 14. The coolant which remains in the cavity 4 of the cylinder block 2 does not participate in this circulation and thus allows rapid heating-up of the cylinder walls, so that friction losses are very quickly overcome and cold water is avoided. In this position of the control, the coolant which flows through the cavity 5 does not include the quantity of coolant remaining in the cavity 4 of the cylinder block and in the cooler 11 and the pipe 12 and is correspondingly rapidly heated thus allowing increased heating of the cylinder head 3, whereafter the coolant is eventually diverted by the thermostat 10 to an increasing extent via the cooler 11.

If the temperature sensor 37 detects a cylinder wall temperature of 180°, for example, the temperature-controlled relay 35 is actuated and breaks the circuit 34, whereby the solenoid 22 is de-energised and the valve 27 is pushed by the spring 38 into the position in which the low-pressure chamber 25 of the pressure capsule 23 is connected through the pipes 26 and 30 and through the throttle 31 to the atmosphere. The suction prevailing in the low-pressure chamber 25 up to this point can be reduced as a result of the arrangement of the throttle 31, but only slowly, so that the valve body within the regulating device 17, which is connected to the diaphragm 24 is moved correspondingly slowly from its first into its second position. As a result of this delay, the second outlet 21 is slowly opened and the first outlet 19 is slowly shut off. The coolant is thus increasingly diverted via the pipeline 20 into the cavity 4 of the cylinder block 2 and from the latter into the cavity 5 of the cylinder head 3, so that the cylinder block 2 is included in the coolant circuit, and coolant flows through both the cylinder block and the cylinder head 3. As a result of the gradual transition from the first to the second position, extreme temperature differences in the cooling fluid circuit are eliminated.

The temperature-controlled relay, which is a threshold or limit switch, reacts again if the cylinder wall temperature as detected by the temperature sensor 37, falls to 170°, for example, as in the case of a coasting vehicle, for instance. Since the passage of the coolant through the cylinder block 2 is again blocked in the manner described above, no great further fall in temperature which might produce friction losses can occur.

The proposed arrangement of the cooling fluid circuit also has the advantage that no overheating of the cylinder walls can occur in the event of failure of the current supply, as the electro-magnet 32 is de-energised and the valve 27 is moved by the spring 38 into the position in which the low-pressure chamber 25 is connected to the atmosphere and the valve body within the regulating device 27 permits coolant flow both through the cylinder head 3 and also the cylinder block 2, and cooling of the cylinder block is therefore ensured.

Figure 2:
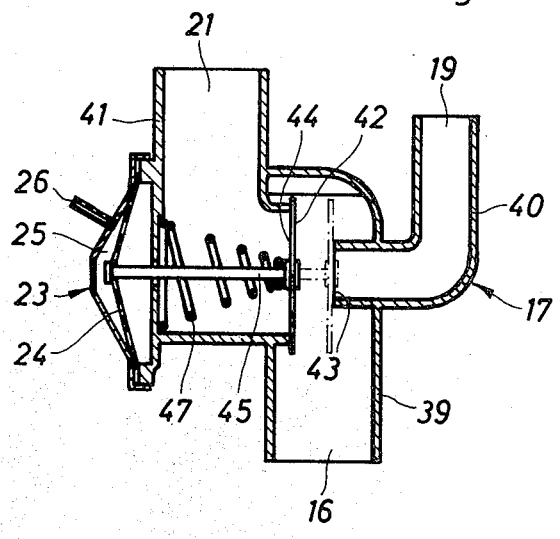
FIG. 2 is a diagrammatic sectional elevation through a regulating device for controlling the coolant circuit in FIG. 1.

FIG. 2 illustrates a regulating device 17 as may be used for example, in the arrangement of FIG. 1. The regulating device 17 essentially consists of a flanged duct 39 forming the inlet 16 and a flanged ducts 40 and 41 forming the first outlet 19 and the second outlet 21 respectively. The device contains a valve body 42 which alternatively shuts off or opens the facing orifices 43 and 44 of the flanged ducts 40 and 41. The valve body 42 is mounted on a valve rod 45, which is rigidly connected to the diaphragm 24 of the pressure capsule 23 which is secured to the regulating device 17.

Between the valve body 42 and the opposing internal surface of the flanged duct 41 is located a compression spring 47, which urges the valve body 42 against the opening 43 of the outlet duct 19. In the position shown however, suction occurs in the low-pressure chamber 25 of the pressure capsule 23, and the valve body 42 is thus pulled into its first position, against the opening 44 in which the second outlet 21 is shut off and the first outlet 19 is opened, so that the coolant is only conveyed into the cylinder head 3—as corresponds also to the position shown in FIG. 1. When the suction loses its effectiveness, the valve body 42 is pushed by the spring 47 into its second position, which is indicated by chain lines, in which the second outlet 21 is opened and the first outlet 19 is closed, whereby the coolant is conveyed not only through the cylinder head 3 but also through the cylinder block 2. In the event of failure of the control system as described, no accelerated heating-up of the cylinder block takes place, and it is ensured that cooling fluid constantly flows round the cylinder walls, for which reason overheating is not likely to occur.

Figure 3:
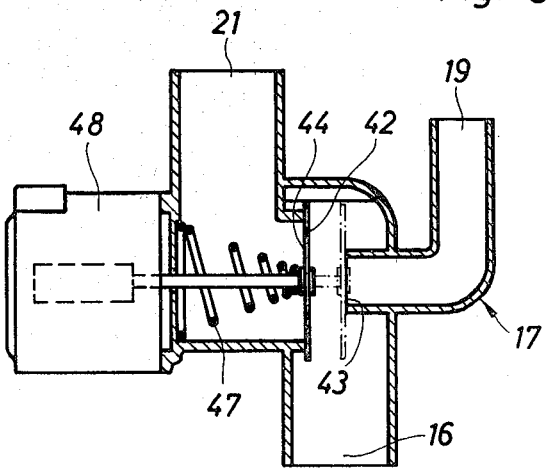
FIG. 3 is an elevation similar to FIG. 2 illustrating a second embodiment.
Figure 4:
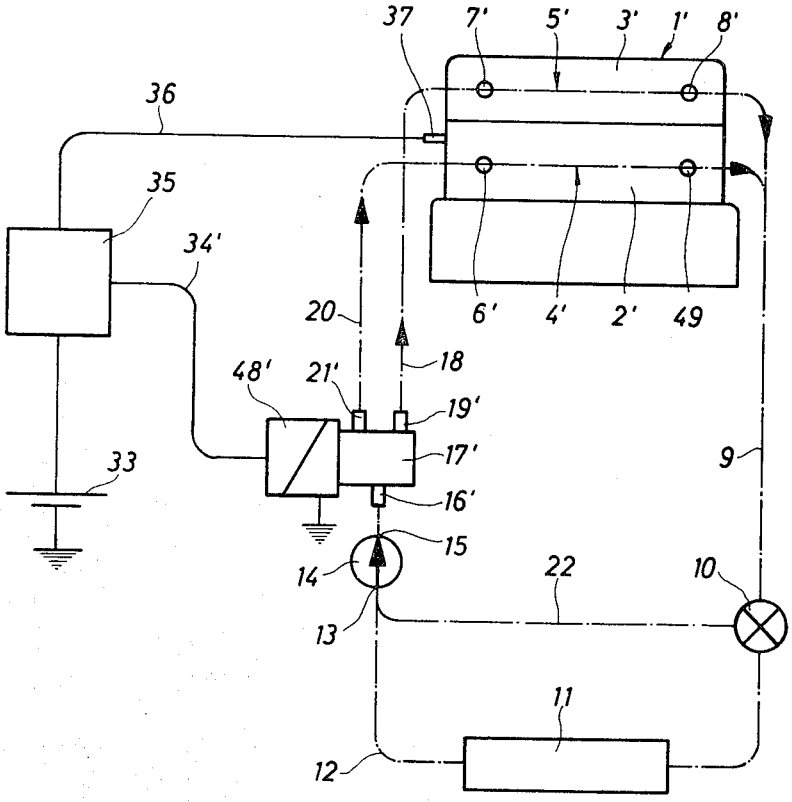
FIG. 4 is a diagrammatic illustration, of an internal combustion engine with an alternative arrangement of the coolant circuit.

In the regulating device 17 shown in FIG. 3, the same reference numbers as in FIG. 2 have been used for identical or similar parts. In contrast to the construction shown in FIG. 2, the valve body 42 is merely actuated by an electro-magnet 48 fastened to the regulating device 17, instead of by a pressure capsule, so that the suction control system can be omitted—as is shown in FIG. 4. The operation of the regulating device 17 is essentially the same as in the construction of FIG. 2, where in the position shown, the electro-magnet 48 remains energised and the valve body 42—as in the construction of FIG. 2—is consequently pulled into its first position, in which the coolant only passes via the outlet 19 into the cylinder head 3. If, on the other hand, the current supply is disconnected, the valve body 42 is pushed by the spring 47 into the opposite second position indicated by dot-dash lines, in which the coolant is conveyed via the outlet 21 into both the cylinder head 2 and the cylinder block 3.

From the diagrammatic general view of FIG. 4, in which the same reference numbers as in FIG. 1 have been used for identical and similar parts, it can be seen, in contrast to the construction of FIG. 1, that no suction control system is provided, but that the temperature-controlled relay 35 is arranged directly in the circuit 34' of the electro-magnet 48' which controls the temperature-controlled regulating device 17'. Furthermore the coolant flows in parallel streams through the cavity 4' of the cylinder block 2' and the cavity 5' of the cylinder block 3', each independently of the other, for which reason the cylinder block 2' has an individual return port 49, which opens into the pipe 9. The control device 17', which is explained in greater detail in the description of FIG. 5, contains a valve body which is not shown in this illustration and is actuated by the electro-magnet 48'.

In this example, in order to obtain rapid heating of the internal combustion engine, the electro-magnet 48' is simultaneously energised when the engine ignition is switched on, whereby the valve body in the control device 17' is pulled into a first position in which the second outlet 21' is closed and the first outlet 19' is opened, so that the coolant is conveyed via the pipe 18 only through the cavity 5' of the cylinder head 3'. As the flow of coolant via the outlet 21' to the cavity 4' in the cylinder block 2' is shut off, the coolant remaining in the cylinder block 2' allows rapid heating-up of the cylinder walls. If after reaching a cylinder wall temperature of 180° C., for example, the temperature-controlled relay 35 is actuated and the circuit 34' therefore broken, the valve body in the regulating device 17' which is connected to the electro-magnet 48', is moved from its first into its second position, in which the second outlet 21' is opened, but the first outlet 19' also remains open. The cylinder block 2' is thus included in the permanently open cooling circuit of the cylinder head 3', and coolant likewise flows through the block.

Figure 5:
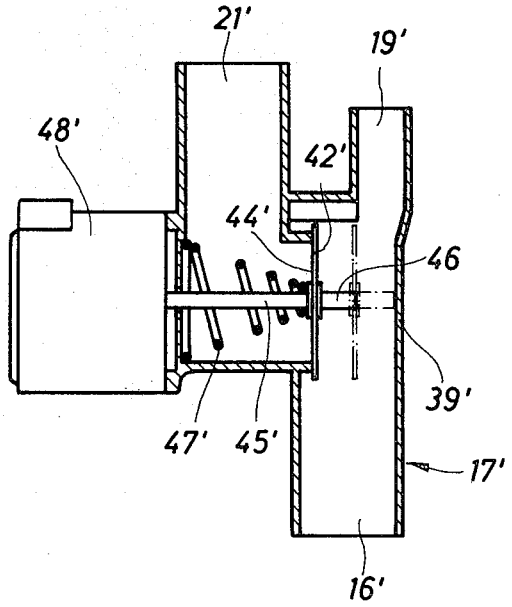
FIG. 5 illustrates a regulating device for controlling the coolant circuit of FIG. 4.

The regulating device 17' shown in FIG. 5, in which the same reference numbers have been used, as in FIG. 2 or FIG. 3 (but with a suffix) contains a valve body 42', which is mounted on a valve rod 45' and is connected to the electro-magnet 48'. This regulating device 17' may be used in the example illustrated in FIG. 4. In the position shown, the electro-magnet 48' remains energised, whereby the valve body 42' is pulled into its first position against the opening 44' connected to the outlet 21', in which the second outlet 21' is shut off, whilst the first outlet 19' is opened, so that the coolant is merely passed into the cylinder head 3'—as shown in FIG. 4. When the electro-magnet 48' is de-energised, the spring 47' presses the valve body 42 into its second position indicated by dot-dash lines, in which a projecting extension 46 of the valve rod 45' comes up against the wall of the flanged duct 39', so that the second outlet 21' is opened and the first outlet 19' remains open. In this position, the coolant is conveyed both through the cylinder head 3' and also through the cylinder block 2'. The last mentioned position is also produced in the event of a current failure, so that overheating is avoided on the cylinder wall of the cylinder block 2', round which cooling fluid flows.

Several modifications of the illustrated embodiments are obviously possible without departing from the scope of the invention. For example, the suction control system shown in FIG. 1 can also be provided in the embodiment of FIG. 4, in which the regulating device of FIG. 5 contains a pressure capsule, as is shown in the embodiment of FIG. 2. Similarly, the suction control system in FIG. 1 can be replaced by a control system such as described in FIG. 4—as already mentioned. It would also be possible to replace the control valves 17 and 17' by other constructions having the same function.

I claim:

1. A liquid-cooled internal combustion engine having a cylinder block and a cylinder head, each formed with an internal coolant cavity having an inlet port; a recirculating pump to which said cavities are connected; a temperature-controlled regulating device for controlling the flow of coolant through said cavities, said regulating device having an inlet which is connected to an output of the recirculating pump, a first outlet which communicates with the inlet port of the cavity in the cylinder head, and a second outlet which communicates with the inlet port of the cavity in the cylinder block, and a valve body which, depending on the temperature of the cylinder block, adopts a first position and closes the second outlet when the temperature lies below a selected value, and adopts a second position and opens said second outlet when the temperature is above this value; a low-pressure source; a pressure capsule for activating said valve body; and a temperature-controlled valve, said pressure capsule being connectable to said low-pressure source or alternatively to the atmosphere by said temperature-controlled valve.

2. A liquid-cooled internal combustion engine as claimed in claim 1, in which the temperature-controlled valve is an electro-magnetic valve, controlled by a temperature-controlled relay.

3. A liquid-cooled internal combustion engine as claimed in claim 1 including a ventilation line connecting said pressure capsule to the atmosphere, a throttle being provided in said ventilation line.

4. A liquid-cooled internal combustion engine having a cylinder block and a cylinder head, each formed with an internal coolant cavity having an inlet port;

a recirculating pump to which said cavities are connected; and a temperature-controlled regulating device for controlling the flow of coolant through the said cavities, said regulating device having an inlet which is connected to an output of the recirculating pump, a first outlet which communicates with the inlet port of the cavity in the cylinder head, a second output which communicates with the inlet port of the cavity in the cylinder block, and a valve body which, depending upon the temperature of the cylinder block, adopts a first position and closes the second outlet when the temperature lies below a selected value, and adopts a second position and opens the second outlet when the temperature is above this value.

5. A liquid-cooled internal combustion engine as claimed in claim 4, in which the first outlet is closed in the second position of the valve body, and the cavities of the cylinder head and cylinder block are connected in series.

6. A liquid-cooled internal combustion engine as claimed in claim 4, in which the inlet and the first outlet of the regulating device are in communication with each other in each position of the valve body, and the cavity in the cylinder head and the cavity in the cylinder block are connected in parallel.

7. A liquid-cooled internal combustion engine as claimed in claim 4, in which the valve body is under the influence of a spring, which urges the valve body towards its second position.

8. A liquid-cooled internal combustion engine as claimed in claim 4, in which a temperature sensor for sensing the temperature of a cylinder wall of the cylinder block is arranged close to the point at which an upper piston ring of a piston within a cylinder comes to rest in its top dead center position.

9. A liquid-cooled internal combustion engine as claimed in claim 4, in which the valve body is actuated by an electro-magnet, controlled by a temperature-controlled relay.

10. A liquid-cooled internal combustion engine as claimed in claim 9, in which the temperature-controlled relay is a threshold switch which has a hysteresis of up to approximately 20°.

* * * * *